US010914077B2

(12) United States Patent
Roy et al.

(10) Patent No.: US 10,914,077 B2
(45) Date of Patent: Feb. 9, 2021

(54) BATTEN AND WALL SYSTEM

(71) Applicant: Advanced Building Products, Inc., Sanford, ME (US)

(72) Inventors: Kenneth A. Roy, Shapleigh, ME (US); Keith A. Lolley, Sanford, ME (US)

(73) Assignee: Advanced Building Products, Inc., Sanford, ME (US)

( * ) Notice: Subject to any disclaimer, the term of this patent is extended or adjusted under 35 U.S.C. 154(b) by 0 days.

(21) Appl. No.: 16/654,399

(22) Filed: Oct. 16, 2019

(65) Prior Publication Data

US 2020/0048912 A1 Feb. 13, 2020

Related U.S. Application Data

(62) Division of application No. 15/784,268, filed on Oct. 16, 2017, now abandoned.

(60) Provisional application No. 62/419,615, filed on Nov. 9, 2016.

(51) Int. Cl.

| | |
|---|---|
| ***E04F 13/00*** | (2006.01) |
| ***E04D 13/17*** | (2006.01) |
| ***E04B 1/70*** | (2006.01) |
| ***E04D 12/00*** | (2006.01) |
| ***E04F 13/08*** | (2006.01) |

(52) U.S. Cl.

CPC ..... *E04F 13/007* (2013.01); *E04B 1/7069* (2013.01); *E04D 12/004* (2013.01); *E04D 13/17* (2013.01); *E04F 13/0803* (2013.01)

(58) Field of Classification Search

CPC .... E04F 13/007; E04F 13/0803; E04D 13/17; E04D 12/004; E04B 1/7069

See application file for complete search history.

(56) References Cited

U.S. PATENT DOCUMENTS

| | | | |
|---|---|---|---|
| 2,479,870 | A | 8/1949 | Rundquist |
| 3,222,697 | A | 12/1965 | Scheermesser |
| 4,393,633 | A | 7/1983 | Charniga |
| D275,705 | S | 9/1984 | Gabriel |
| 5,477,651 | A | 12/1995 | Fitzgibbon |

(Continued)

OTHER PUBLICATIONS

Tamlyn Rainscreen, Tamlyn Xtreme Trim.
DuPont Rainvent, DuPont Tyvek.
Vapro Batten, Vapro Shield.

*Primary Examiner* — Basil S Katcheves
*Assistant Examiner* — Omar F Hijaz
(74) *Attorney, Agent, or Firm* — Hammer & Associates, P.C.

(57) ABSTRACT

A wall (or roof) system includes: an exterior sheathing covers a frame, a plurality of spaced apart battens are affixed on the sheathing, and a siding in contact with the battens. Each batten includes: a backweb having two sides and a length, a plurality of elongated piers upstanding on each side of the backweb, each pier running the length of the backweb, and each pier having a distal surface, and a first air flow channel defined between adjacent piers and a horizontal pier cutting through adjacent piers. Air flows between airspaces created between the exterior sheathing and the siding by the batten. Air also flows through the first air flow channel and this air flow may reduce moisture entrapment between the batten and the siding or the exterior sheathing. The batten may also have a second air flow channel at an angle to the first air flow channel.

11 Claims, 3 Drawing Sheets

(56) References Cited

U.S. PATENT DOCUMENTS

| | | | | |
|---|---|---|---|---|
| 5,493,839 | A | 2/1996 | Sax | |
| 5,600,928 | A | 2/1997 | Hess | |
| 5,688,073 | A | 11/1997 | Brodeur et al. | |
| 6,267,668 | B1 | 7/2001 | Morris | |
| 6,357,193 | B1 | 3/2002 | Morris | |
| 6,557,313 | B1 | 5/2003 | Alderman | |
| 6,594,964 | B2 | 7/2003 | Charland | |
| 6,938,383 | B2 | 9/2005 | Morris et al. | |
| 7,090,911 | B2 | 8/2006 | Lascelles | |
| 7,117,649 | B2 | 10/2006 | Morris et al. | |
| RE39,825 | E | 9/2007 | Morris et al. | |
| 7,607,270 | B2 | 10/2009 | Ehrman | |
| 7,617,638 | B1 | 11/2009 | Slama et al. | |
| 8,001,736 | B2 | 8/2011 | Goldberg | |
| 8,033,073 | B1 | 10/2011 | Binder | |
| 8,453,399 | B2 | 6/2013 | Anderson | |
| 8,549,806 | B2 | 10/2013 | Snyder | |
| 8,919,061 | B2 | 12/2014 | Kortuem | |
| 9,745,753 | B1 | 8/2017 | Petersen | |
| 9,790,684 | B2 | 10/2017 | Neumayr | |
| 2006/0150536 | A1 | 7/2006 | Smith | |
| 2007/0113499 | A1 | 5/2007 | Williams | |
| 2008/0034690 | A1 | 2/2008 | Gartz | |
| 2008/0163582 | A1* | 7/2008 | Trevethick | E04B 2/707 52/716.2 |
| 2012/0017525 | A1 | 1/2012 | Knapp | |
| 2012/0317923 | A1 | 12/2012 | Herdt | |
| 2014/0246146 | A1 | 9/2014 | Walker | |
| 2014/0305063 | A1* | 10/2014 | Kim | E04F 13/0805 52/489.1 |

* cited by examiner

BATTEN AND WALL SYSTEM

RELATED APPLICATIONS

This application is a divisional application of U.S. patent application Ser. No. 15/784,268 filed Oct. 16, 2017, now abandoned, which claims the benefit of U.S. Provisional Application Ser. No. 62/419,615 filed Nov. 9, 2016.

FIELD OF THE INVENTION

This invention is related to a batten (or furring strip) and the wall (and/or roof) system in which same is used.

BACKGROUND OF THE INVENTION

In building construction, battens (or furring strips) are used between the exterior sheathing on the frame and the siding. The use of the batten creates an airspace between the exterior sheathing and the siding. It is known that such airspaces, and creating air flow in that space, is beneficial. One benefit is the prevention of moisture (or dampness) accumulation within the wall (and/or roof) system of the building.

Historically, battens (or furring strips) were made of wood; but today, they are being replaced with new products, such as, for example, see for example U.S. Pat. Nos. 6,267,668, 6,357,193, USRe39825, U.S. Pat. Nos. 6,938,383, 7,117,649, 7,617,638, 8,453,399, 8,549,806, DuPont's RAINVENT™ Batten product, Tamlyn's RAINSCREEN, and VaproShield's VAPROBATTEN, each incorporated herein by reference. These new products promote air flow between the airspaces which could not be accomplished by their solid wooden predecessors.

While these new products are beneficial, a new source of moisture entrapment has arisen with their use. Each of these new devices has a solid non-pervious surface in contact with the siding. Moisture (or dampness) may be trapped between that surface and siding (and/or exterior sheathing). This is a problem.

Accordingly, there is an need for a new batten (or furring strip) that eliminates or reduces the potential for the entrapment of moisture (or dampness) between the batten (or furring strip) and the siding (and/or the exterior sheathing).

SUMMARY OF THE INVENTION

A wall (or roof) system includes: an exterior sheathing covers a frame, a plurality of spaced apart battens are affixed on the sheathing, and a siding in contact with the battens. Each batten includes: a backweb having two sides and a length, a plurality of elongated piers upstanding on each side of the backweb, each pier running the length of the backweb, and each pier having a distal surface, and a first air flow channel defined between adjacent piers and a horizontal pier cutting through adjacent piers. Air flows between airspaces created between the exterior sheathing and the siding by the batten. Air also flows through the first air flow channel and this air flow may reduce moisture entrapment between the batten and the siding or the exterior sheathing. The batten may also have a second air flow channel at an angle to the first air flow channel.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

Figure 1A:
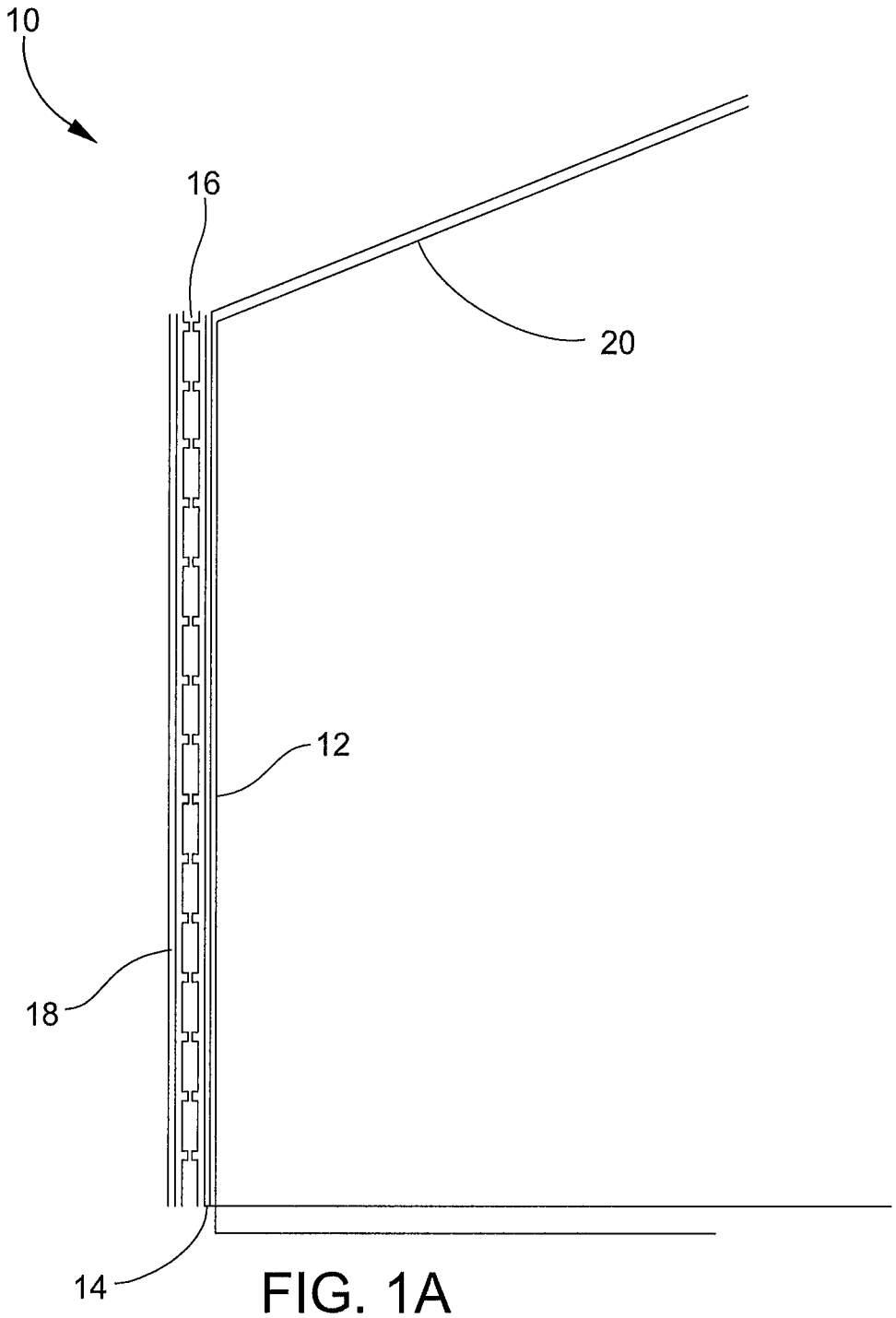
FIG. 1A is an environmental view of an embodiment of the invention used in a wall system.
Figure 1B:
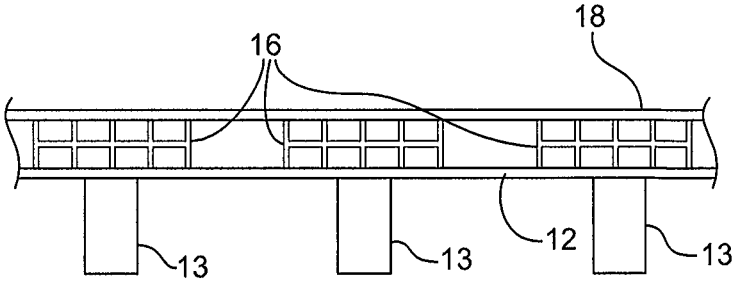
FIG. 1B is a top plan view of the embodiment shown in FIG. 1A.

Referring to the drawings wherein like numerals refer to like elements, there is shown, in FIG. 1, a wall system 10. While the instant invention is described hereinafter with regard to a wall system, it will readily apparent to those of ordinary skill that the invention may be used in a roof system 20. Therefore, wall system and roof system may be used, herein, interchangeably.

Wall system 10 generally includes an exterior sheathing 12 covering a frame 13, a plurality of battens (or furring strips) 16 affixed to the exterior sheathing 16, and a siding 18 in contact with (and/or affixed to) the battens 16. In the wall system 10, the battens may be disposed vertically on the exterior sheathing and are spaced apart. The battens 16 may also be placed around wall openings, for example windows, doors, vents. An airspace is created between the exterior sheathing and the siding by the battens placed therebetween. Additionally, a moisture barrier 14 may be wrapped over the exterior sheathing 12 and is between the exterior sheathing 12 and the batten 16. The exterior sheathing 12, the frame, and the siding 18 are conventional. The siding 18 may be, for example: wood, vinyl, aluminum, stucco, cementitious plank, brick, and combinations thereof.

Figure 2:
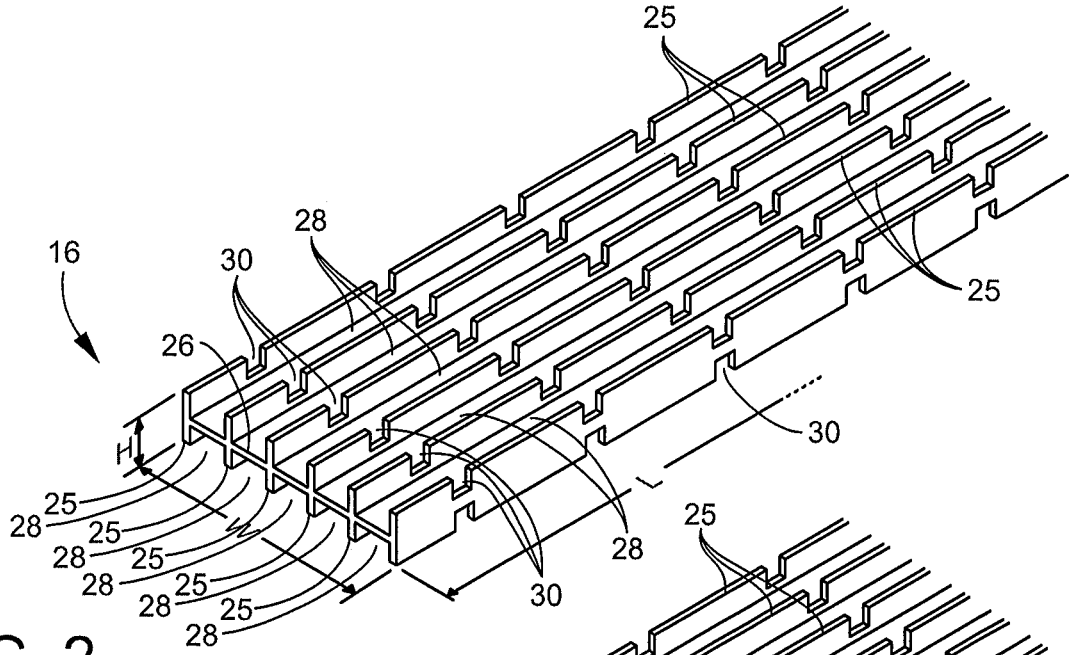
FIG. 2 is an isometric view of an end of the embodiment shown in FIG. 1.
Figure 3:
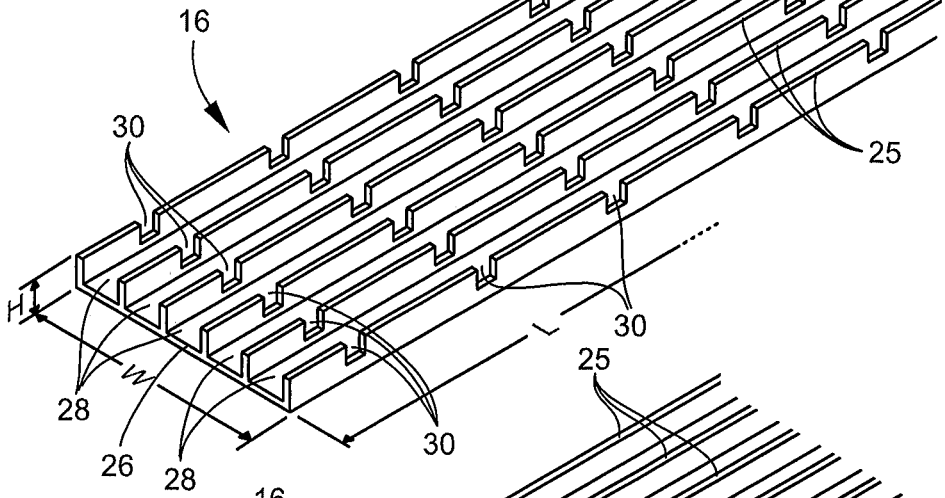
FIG. 3 is an isometric view of an end of another embodiment.
Figure 4:
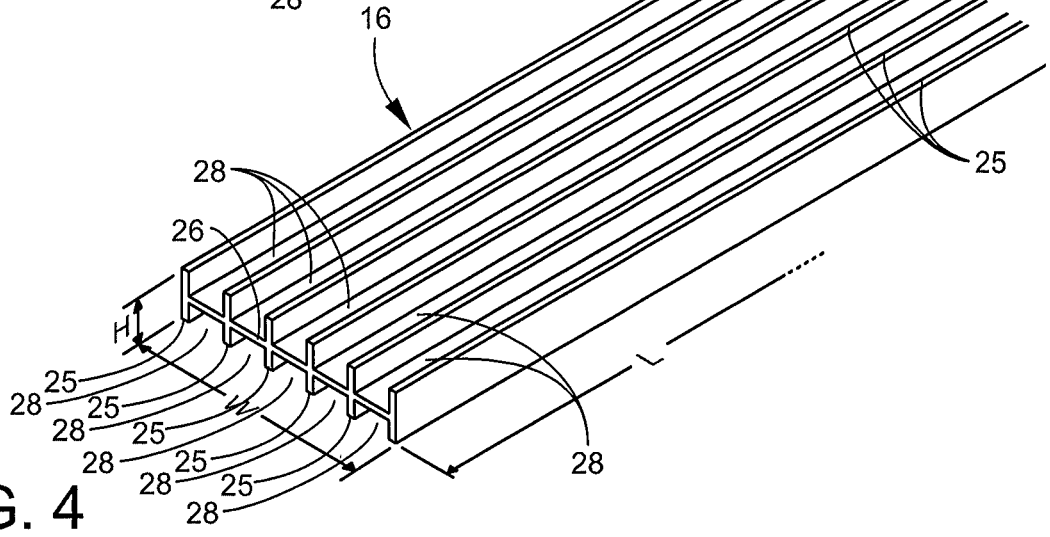
FIG. 4 is an isometric view of an end of another embodiment.
Figure 5:
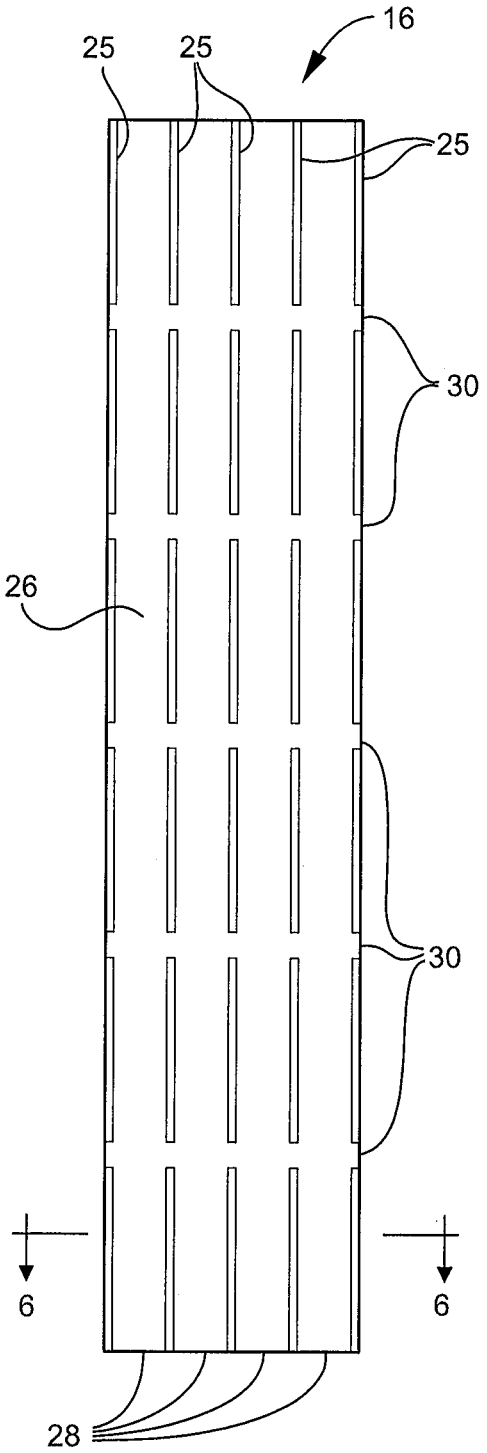
FIG. 5 is a top plan view of the embodiment shown in FIGS. 2 and 3.
Figure 6:
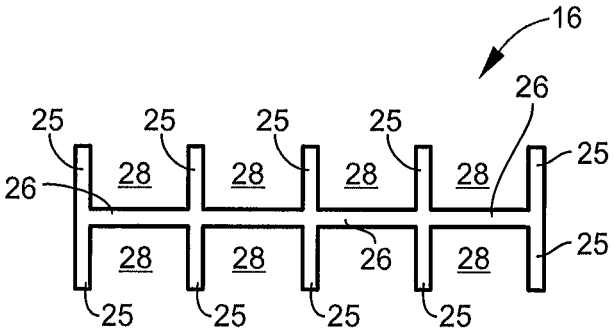
FIG. 6 is an elevational view of the end of the embodiment shown in FIG. 2.
Figure 7:
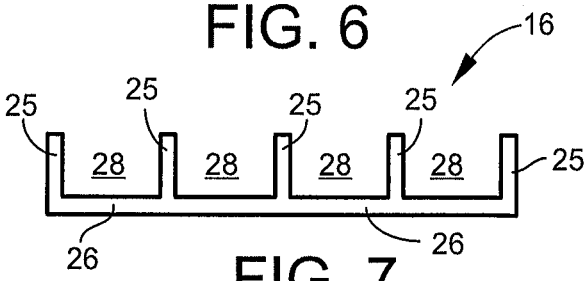
FIG. 7 is an elevational view of the end of the embodiment shown in FIG. 3.

Several embodiments of the battens 16 are illustrated in FIGS. 2-4. In general, the batten 16, see FIGS. 2-4, is an elongated strip having a backweb 26, a plurality of piers 25 upstanding on the backweb 26, and a first air flow channel 28. The batten may be made (e.g., molded or extruded) from a thermoplastic. The thermoplastic may be selected from the group consisting of polyolefins, polyesters, and polyamides. The batten may have any width (W) dimension. In one embodiment, the width may be in a range of 1¼" to 2½". In another embodiment, the width may be in a range of 1⅝"-2".

The piers 25 may be integral with the backweb 26 (i.e., molded or extruded as a continuous body). In the embodiments shown in FIGS. 2 and 4, the piers 25 are upstanding on both sides of the backweb 26. In the embodiment of FIG. 3, the piers are upstanding on only on one side of the backweb 26. The piers 25 may be generally elongated and generally extend the length (L) of the batten. The thickness of individual piers may vary or be uniform across the width (W) of the batten, and the thickness may be selected to prevent crushing of the batten during installation. In one embodiment, if the batten has a width in the range of 1⅝"-2", the pier thickness may be about 1/16". The height of piers 25 may vary, but is generally the same across the width of the batten. In one embodiment, if the batten has a width in the range of 1⅝"-2", the pier height may be about ⅛" (measured from the center of the backweb).

Figure 8A:
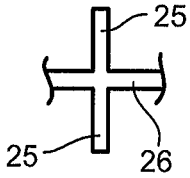
FIGS. 8A, 8B, 8C, and 8D are illustrations of various profiles of the piers of the embodiments shown in FIGS. 2-4.
Figure 8B:
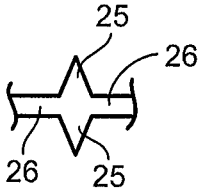
Figure 8C:
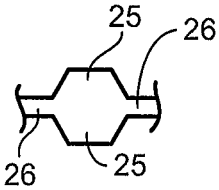
Figure 8D:
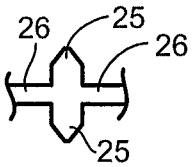

In general, the cross-section profile of the pier 25 is chosen to minimize the contact surface between the batten and the exterior sheathing or siding. This contact area is where moisture may be trapped. Exemplary, but non-limiting, pier 25 cross-sectional profiles are illustrated in FIGS. 8A-D (additionally the cross section may be rounded or semi-circular—not shown). FIG. 8A shows a generally rectangular cross section. FIG. 8B shows a generally triangular cross section. FIG. 8C shows a generally trapezoidal cross-section. FIG. 8D shows a combination of the foregoing cross sections.

First air flow channel 28 is defined between adjacent piers 25 and the back web 26. These channels 28 may allow air to move within the batten 16.

A second air flow channel 30, see the embodiments shown in FIGS. 2 and 3, may be formed (or molded or cut) into the piers 25. The shape of the second air flow channel 30 is shown as square or rectangular, but is not so limited and may have any shape that promotes air flow. Such shapes, additionally, include: semicircular, semi-oval, triangular, trapezoidal, and/or comb-like. The second air flow channel 30 is defined through adjacent piers 25 and allows air flow (cross-flow) between adjacent air spaces formed by placing the batten between the exterior sheathing and the siding. The second flow channel is at an angle to the first flow channel. The angle may vary between about <0° to about 90°. In one embodiment, the second flow channel is generally perpendicular to the first flow channel. In one embodiment, the second flow channel 30 is generally horizontally disposed across the batten 16. However, the invention is not so limited and second flow channel 30 may be staggered (not shown), so long as an air flow path across the batten 16 is maintained. Additionally, while second air flow channels 30, shown in FIG. 2 are in register (i.e., channel 30 are aligned top and bottom), the need not be and may be out of register (or e.g., staggered).

When the battens 16 are placed (e.g., vertically disposed) in the wall system 10, see FIG. 1, air flows between airspaces created by the batten 16 between the exterior sheathing 12 and the siding 18. The air flows through the first air flow channel 28 and, if present, the second air flow channel 30, and thereby reduces (or eliminates) any moisture entrapment between the batten 16 and the siding 18.

Moreover, battens 16 may significantly reduced contact area with the siding 18 and/or the exterior sheathing 12, when compared with existing battens, for example see U.S. Pat. Nos. 6,267,668, 6,357,193, USRe39825, U.S. Pat. Nos. 6,938,383, 7,117,649, 7,617,638, 8,453,399, 8,549,806, DuPont's RAINVENT™ Batten product, Tamlyn's RAINSCREEN, and VaproShield's VAPROBATTEN, each is incorporated herein by reference. In one embodiment of the invention, the reduced contact area may be 20-85% less than the existing battens. In another embodiment, the reduced contact area may be at least 50% less than the existing battens. The benefit of the reduced contact area is the elimination of and/or reduction in the entrapment of moisture (or dampness) between the batten (or furring strip) and the siding.

The present invention may be embodied in other forms without departing from the spirit and the essential attributes thereof, and, accordingly, reference should be made to the appended claims, rather than to the foregoing specification, as indicated the scope of the invention.

We claim:

1. A batten for a wall or roof system with a siding and an exterior sheathing comprises:

a backweb having a first side, a second side, and a length, a plurality of elongated piers are upstanding on the first side of the backweb, each pier running the length of the backweb, each pier having parallel sides terminating with a distal surface for engagement with the siding or exterior sheathing, the distal surface having a cross-sectional shape chosen to minimize contact between the batten and the siding or the exterior sheathing including flat, triangular, trapezoidal, rounded, and/or a combination of cross-sections, a plurality of elongated piers are upstanding on the second side of the backweb, each pier running the length of the backweb, each pier having parallel sides terminating with a distal surface for engagement with the siding or exterior sheathing, and the distal surface having a cross-sectional shape chosen to minimize contact between the batten and the siding or the exterior sheathing including flat, triangular, trapezoidal, rounded, and/or a combination of cross-sections, a plurality of first air flow channels with a rectangular cross section are defined between adjacent piers on the first side of the backweb, a plurality of first air flow channels with a rectangular cross section are defined between adjacent piers on the second side of the backweb;

a plurality of second air flow channels, each second air flow channel is at an angle to the first air flow channel and is defined through adjacent piers on the first side of the backweb, a plurality of second air flow channels, each second air flow channel is at an angle to the first air flow channel and is defined through adjacent piers on the second side of the backweb; and a siding in contact with the distal surfaces of the battens, wherein air flows within the first air flow channel and the second air flow channel thereby reducing moisture entrapment between the batten and the siding or the exterior sheathing.

2. The batten of claim 1 wherein the second air flow channel is generally perpendicular to the first air flow channel.

3. The batten of claim 1 wherein the batten is made of an extrudable thermoplastic.

4. The batten of claim 1 wherein the thermoplastic is selected from the group consisting of polyolefins, polyesters, and polyamides.

5. A wall or roof system comprises the batten of claim 1.

6. The wall or roof system of claim 5 wherein the batten is vertically disposed in the wall system.

7. A batten for a wall or roof system with a siding and an exterior sheathing comprises:

a thermoplastic backweb having a first side, a second side, and a length, five or more elongated spaced apart thermoplastic piers are upstanding on the first side of the backweb and interconnected via the backweb, each pier running the length of the backweb, each pier having a distal end for engagement with the siding or exterior sheathing, and each pier has a cross-section shape chosen to minimize contact between the batten and the siding or the exterior sheathing including flat, triangular, trapezoidal, rounded, or a combination of cross-sections, five or more elongated piers are upstanding on the second side of the backweb, each pier running the length of the backweb, each pier having a distal surface for engagement with the siding or exterior sheathing, and a cross-section shape chosen to minimize contact between the batten and the siding or the exterior sheathing including flat, triangular, trapezoidal, rounded, and/or a combination of cross-sections, four or more first air flow channels with a rectangular cross section are defined between adjacent piers on the first side of the backweb and the second side of the backweb; and a plurality of second air flow channels, each second air flow channel is at an angle to the first air flow channel and is defined by notches through adjacent piers on the first side of the backweb and the second side of the backweb;

wherein air flows through the first air flow channel and the second air flow channel, thereby reducing moisture entrapment between the batten and the siding or the exterior sheathing.

8. The batten of claim 7 wherein the second air flow channel is generally perpendicular to the first air flow channel.

9. The batten of claim 7 wherein the thermoplastic backweb and piers are made of an extrudable thermoplastic.

10. The batten of claim 7 wherein the thermoplastic is selected from the group consisting of polyolefins, polyesters, and polyamides.

11. The batten of claim 7 wherein the battens are vertically disposed in the wall system.

* * * * *